US005513699A

United States Patent [19]

Menze et al.

[11] Patent Number: 5,513,699

[45] Date of Patent: May 7, 1996

[54] HEAT EXCHANGER WALL, IN PARTICULAR FOR SPRAY VAPORIZATION

[75] Inventors: Klaus Menze, Erbach; Gerhard Schuez, Voehringen; Axel Kriegsmann, Ulm; Manfred Knab, Dornstadt; Manfred Hage, Senden, all of Germany

[73] Assignee: Wieland-Werke AG, Ulm, Germany

[21] Appl. No.: 184,599

[22] Filed: Jan. 21, 1994

[30] Foreign Application Priority Data

Jan. 22, 1993 [DE] Germany ..... 43 01 668.5

[51] Int. Cl.[6] ..... F28F 1/16

[52] U.S. Cl. ..... 165/133; 165/184

[58] Field of Search ..... 165/133, 179, 165/184; 29/890.053, 890.046, 890.048

[56] References Cited

U.S. PATENT DOCUMENTS

| | | | |
|---|---|---|---|
| 3,326,283 | 6/1967 | Ware | 165/133 X |
| 3,327,512 | 6/1967 | Novak et al. | 72/367 |
| 3,566,514 | 3/1971 | Szumigala | 29/558 |
| 3,906,605 | 9/1975 | McLain | 165/133 X |
| 4,733,698 | 3/1988 | Sato | 165/179 X |
| 5,186,252 | 2/1993 | Nishizawa et al. | 165/133 X |
| 5,203,404 | 4/1993 | Chiang et al. | 165/133 |
| 5,332,034 | 7/1994 | Chiang et al. | 165/184 |

FOREIGN PATENT DOCUMENTS

| | | | |
|---|---|---|---|
| 1501656 | 10/1969 | Germany . | |
| 18092 | 2/1983 | Japan | 165/133 |
| 46490 | 3/1984 | Japan | 165/133 |
| 64194 | 4/1985 | Japan | 165/133 |
| 37693 | 2/1987 | Japan | 165/133 |
| 237295 | 10/1987 | Japan | 165/184 |

OTHER PUBLICATIONS

Brochure, "F–tube", Furukawa Electric Co., Ltd–Metals Division, 6–1 Marunouchi 2–Chome, Chiyoca–ku, Tokyo, 100 Japan, (undated).

*Primary Examiner*—Leonard R. Leo
*Attorney, Agent, or Firm*—Flynn, Thiel, Boutell & Tanis

[57] ABSTRACT

A heat exchanger wall for the transfer of heat from one first medium on one side of the wall to a second medium to be evaporated on the other side of the wall, with this other side having integral, aligned distributor grooves for distributing the liquid phase of the second medium. Good distribution of the liquid on the surface of the heat exchanger wall and simultaneous good vaporization characteristics are guaranteed according to the invention by the following characteristics:

a) the distributor grooves cross channels having a pitch t, which channels lie below the distributor grooves, b) the distributor grooves are formed by laterally displaced material of the channel walls, with the depth T of the distributor grooves lying approximately between 30% and 90% of the channel height h, and c) the distributor grooves are connected to the channels through flared segments and/or openings in the distributor grooves.

17 Claims, 8 Drawing Sheets

HEAT EXCHANGER WALL, IN PARTICULAR FOR SPRAY VAPORIZATION

FIELD OF THE INVENTION

The invention relates to a surface configuration for a heat exchanger wall.

BACKGROUND OF THE INVENTION

A heat exchanger wall is, for example, present in a heat exchanger tube for spray vaporization in a plural-tube heat exchanger (compare FIG. 1). The medium to be evaporated or vaporized is, in spray vaporizers, applied or sprayed in an enclosed volume onto the tubes. The advantage is that the free space between the tubes does not need to be filled with liquid. This minimizes the amount of fill needed for such apparatus. The type of spraying must assure that the tubes are at all times sufficiently covered with liquid. In order to meet this requirement, these systems are operated with an excess amount of liquid, which is up to a factor 10 higher than the amount of liquid needed for the vaporization operation. However, the heat-transfer coefficient of the vaporization is significantly reduced by the excess liquid. To compensate for this reduction, the plural-tube heat exchanger must be oversized. The pump must be chosen of a suitable size for the circulation of the amounts of liquid needed for vaporization and for the liquid. This causes a high energy consumption by the pump, which factor is approximately 2 times the energy consumption needed when only the amount of liquid required for vaporization is conveyed.

Tubes are known from the field of absorption heat pumps, which tubes have V-shaped grooves on the outside thereof for improving the distribution of the liquid on the tube in an axial direction. Such tubes have been developed for use in expellers (brochure leaflet "F-tube" by the Firm Furukawa Electric Co., Ltd.).

The basic purpose of the invention is to provide a heat exchanger wall of the above-mentioned type in such a manner that aside from a good distribution of the liquid on its surface, good vaporization characteristics are guaranteed at the same time.

SUMMARY OF THE INVENTION

The purpose is attained according to the invention by the following characteristics:

a) the distributor grooves intersect with channels having a pitch t, which channels lie below the distributor grooves, b) the distributor grooves are formed by laterally displaced material of the walls of the channels, the depth T of the distributor grooves lying approximately between 30% and 90% of the channel height h, and c) the distributor grooves are connected to the channels through flared segments and/or openings in the distributor grooves.

It has been found that with the described design of the tube or wall surface a complete wetting of the surface can be achieved already with very small amounts of liquid. In connection with the clearly improved vaporization characteristics, it is thus possible, in particular in plural-tube heat exchangers, to minimize the number of tubes used and the amount of liquid needed in the cycle. A further advantage is that the entire system, into which the plural-tube heat exchanger is integrated, can be built smaller and more compact.

According to a special design of the invention, the distributor grooves extend parallel to one another, in particular two groups of parallel distributor grooves cross at an angle $\beta$.

According to alternative designs, the distributor grooves are spaced apart—the distance being preferably $a \leqq 3 \times t$—or they directly follow one another.

The distributor grooves are advantageously essentially V-shaped, with the depth being T=0.3 mm to 1.5 mm and the opening angle being $\alpha$=30° to 90°. (The depth T is thereby measured from the upper edge of the channel walls.)

The distributor grooves have the purpose of distributing liquid, which is dripped or sprayed thereon, on the outer surface and to feed the liquid in a purposeful manner to the channels lying therebelow. The distributor grooves can for this purpose have suitable openings in addition to the flared segments. The openings can according to the invention be of different design. They can be hole-like, namely the flanks of the grooves are perforated, while in each case the flanks and the groove base are continuous. On the other hand, it is possible to design the openings slot-like, namely the crests are continuous, and the base of the groove is perforated, or vice versa the crests are perforated, and the base of the groove is continuous. According to a further embodiment, the openings are formed by narrow interruptions of the distributor grooves. The simultaneous arrangement of different types of openings on one heat exchanger wall can be advantageous for certain uses.

It is important that the dimensions of the openings are chosen such that at each opening only a portion of the liquid leaves the groove, however, the largest portion is guided on along the groove. Driving forces effecting liquid distribution are the inertia forces, the capillary forces and (in the case of inclined or vertically oriented surfaces) the force of gravity. In the crossed design, the liquid is newly divided at every point of intersection so that the distributing action is significantly better than in the case of parallel grooves.

It is advisable that the parallel channels have the following dimensions:

| | |
|---|---|
| Pitch | t = 0.40 mm to 1.5 mm, |
| Height | h = 0.5 × t to 2 × t, |
| Channel Wall thickness | s = 0.2 × t to 0.8 × t. |

According to a preferred embodiment, the heat exchanger wall is designed as a heat exchanger tube, with the channels and the distributor grooves extending on the outer surface of the heat exchanger tube each extending at an angle of between 0° and 90° with respect to the longitudinal axis of the tube. The channels and the distributor grooves extend preferably helically, in particular, the distributor grooves extend at a pitch angle $\delta$=0° to 60° or 120° to 180° with respect to the longitudinal axis of the tube.

In particular for the further improvement of the vaporization characteristics, the inner surface of the heat exchanger tube is structured, namely, ribbed.

It is suggested to manufacture the tube of the invention according to the following method:

According to a first methodology, first helically extending channels are formed by displacing the material of a smooth wall tube radially outwardly by means of a rolling operation (compare the common rolling method for ribbed tube manufacture, for example, according to U.S. Pat. No. 3,327,512), and subsequently by forming the distributor grooves by a deformation of segments of the channel walls through a rolling operation utilizing suitably formed toothed disks, pressure rollers or the like (compare, for example, DE-OS 1 501 656).

According to a second suggestion, channels extending in an axial direction or extending helically are first formed in a smooth tube wall by a drawing operation utilizing a stationary or rotating drawing matrix and the distributor grooves are subsequently formed by a deformation of segments of the channel walls through a rolling operation utilizing suitably formed toothed disks, pressure rollers or the like.

According to a third suggestion, helically extending channels are first formed displacing the material of a smooth wall tube radially outwardly by means of a rolling operation and subsequently the distributor grooves are formed by a drawing operation with a stationary or rotating drawing matrix.

According to a fourth suggestion, channels extending in an axial direction or extending helically are first formed in a smooth wall tube by a drawing operation utilizing a stationary or rotating drawing matrix, and the distributor grooves are subsequently manufactured through a drawing operation utilizing a stationary or rotating drawing matrix.

The heat exchanger wall of the invention is preferably used for cooling electrical structural elements.

The heat exchanger tube of the invention is preferably utilized for spray vaporization in a plural-tube heat exchanger with horizontally or inclined arranged heat exchanger tubes.

BRIEF DESCRIPTION OF THE DRAWINGS

The invention will be discussed in greater detail in connection with the following exemplary embodiments.

In the drawings.

DETAILED DESCRIPTION

Figure 1:
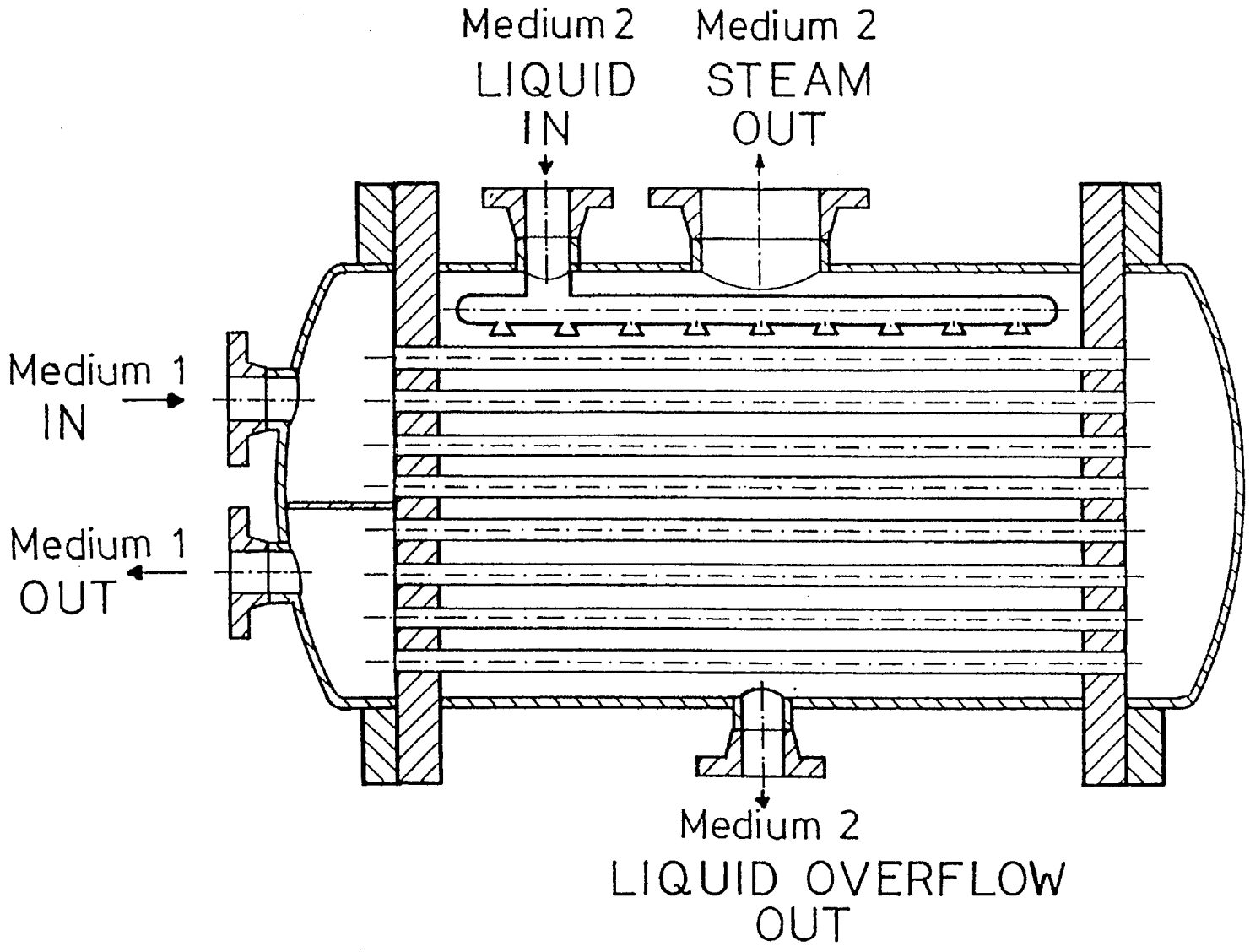
FIG. 1 illustrates a conventional plural tube heat exchanger.

A metal heat exchanger wall 1 according to FIGS. 2 to 5 has on one side a first medium 2 and on the other side a second medium 3 which is to be evaporated or vaporized. The wall 1 has on this other side channels 4 (with channel walls 5), which channels are parallel to one another, the dimensions of which, namely, the pitch t, height h and wall thickness s, are also shown. The channels 4 are crossed by distributor grooves 6 for the second medium 3, which grooves are formed by laterally displaced material of the channel walls 5. The grooves 6 are essentially V-shaped. The depth of the grooves 6 calculated from the upper edge of the channel walls 5 is identified by the letter T, its opening angle by α (the V-shaped grooves 6 are here shown with a tapered groove base. However, the base of the groove will usually be wider.) In order to be able to distribute the dripped on or sprayed on second medium 3 into the channels, the grooves 6 have flared segments 7 and/or openings 8. Depending on the deformation of the channel walls 5 the flared segments 7 and/or openings 8 are designed differently (compare in particular FIGS. 7*a*–7*f*).

Figure 2:
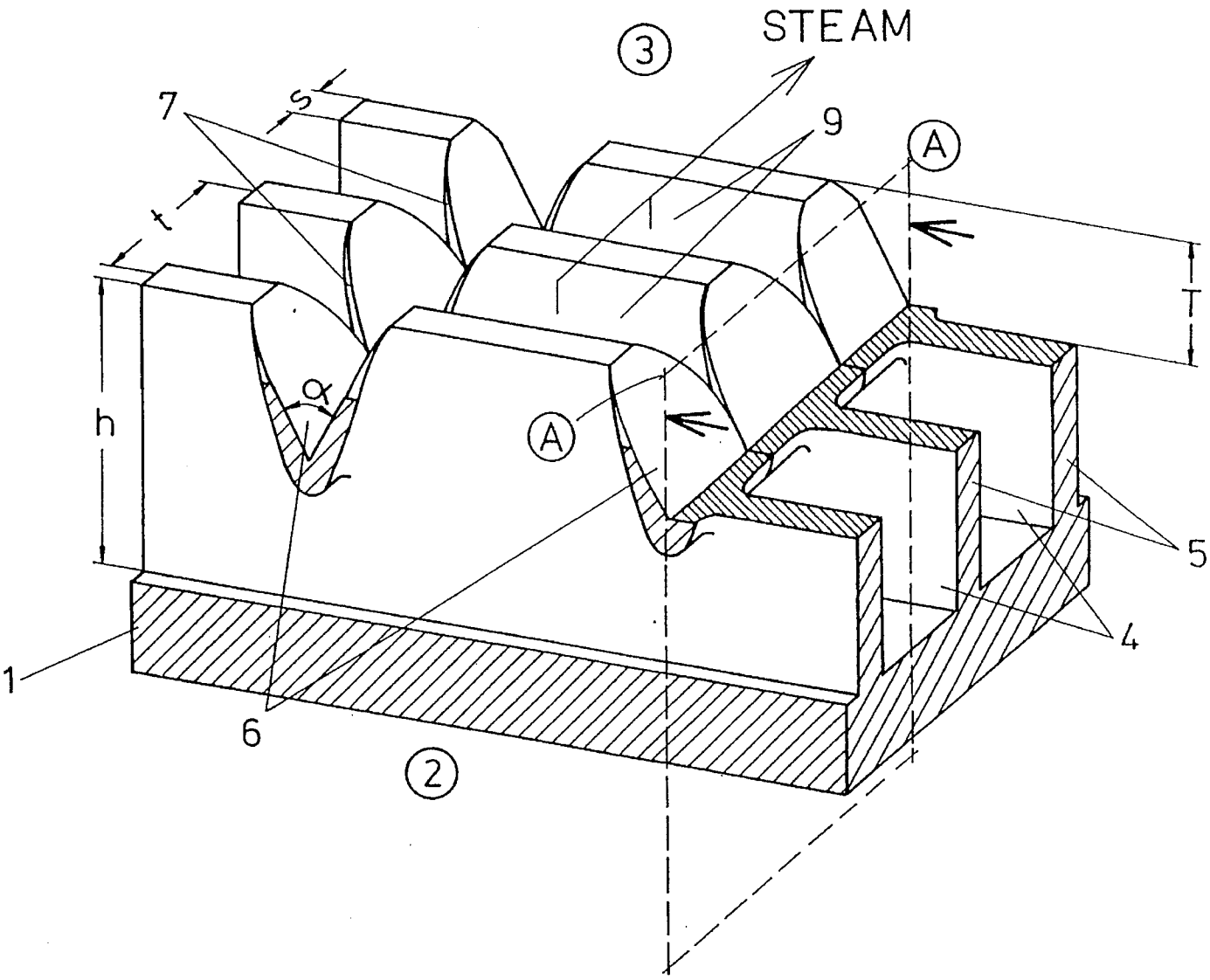
FIG. 2 shows a first embodiment of a heat exchanger wall with parallel extending distributor grooves according to the invention.
Figure 5:
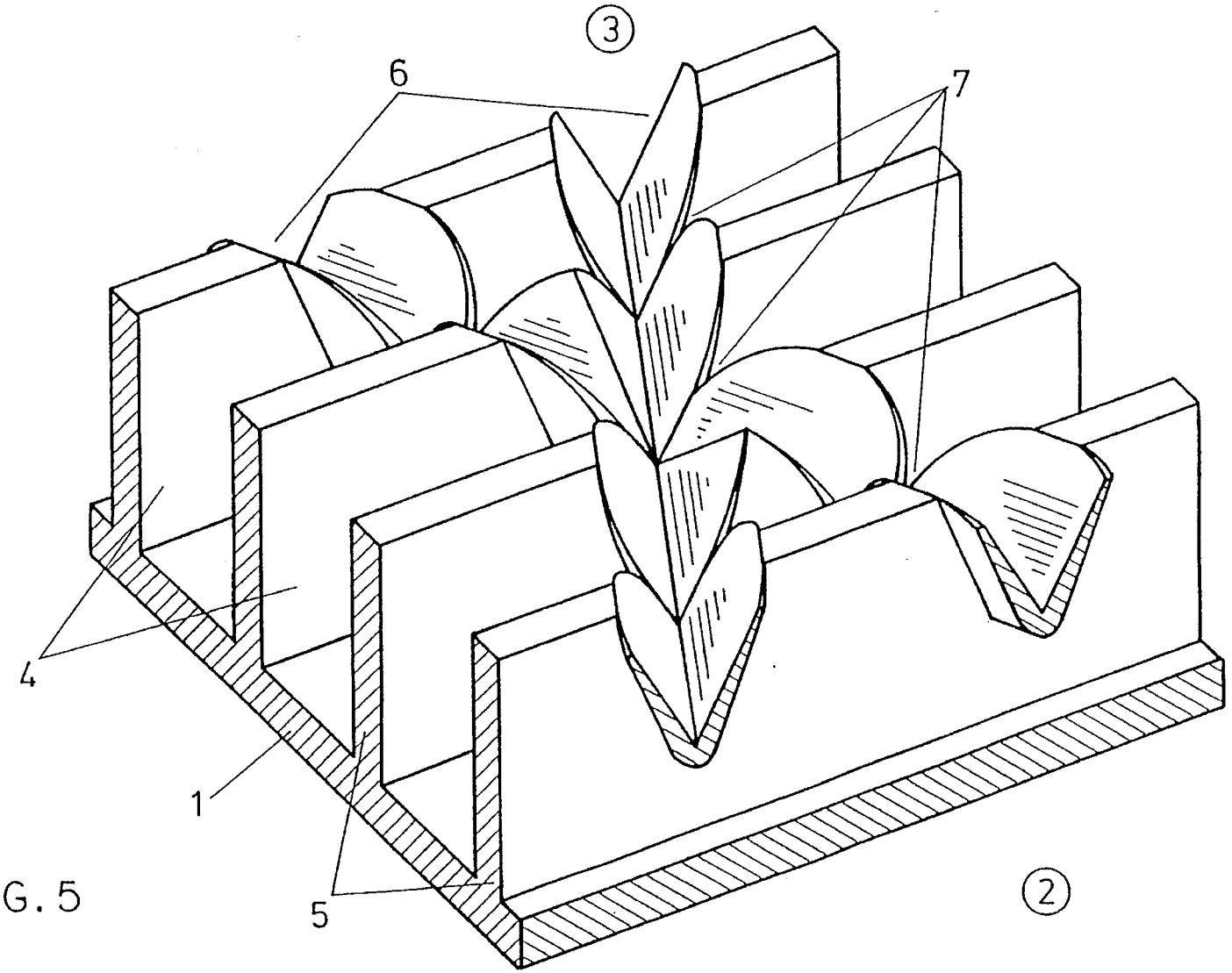
FIG. 5 shows a heat exchanger wall with two crossing distributor grooves according to the invention.

In the case of FIGS. 2 and 5 where only flared segments 7 exist, the deformed material of adjacent channel walls 5 does not contact each other.

Figure 3:
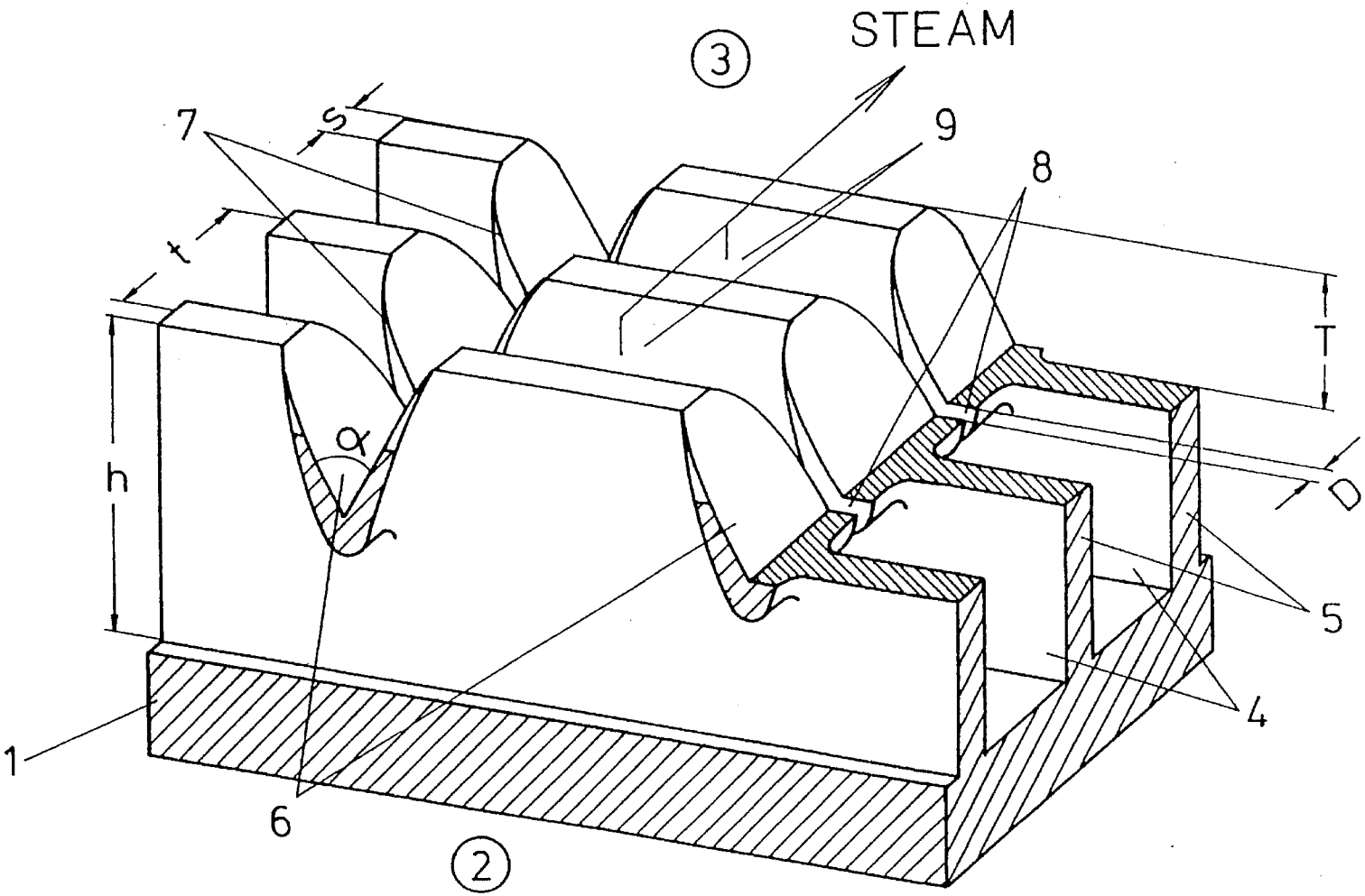
FIG. 3 shows a second embodiment of a heat exchanger wall with parallel distributor grooves according to the invention.

In the case of FIG. 3, since the deformed material of adjacent channel walls 5 does not contact each other, openings 8 are provided in addition to the flared segments 7; the openings 8 being in the form of narrow gaps having a gap width D. This gap width D is not supposed to be more than approximately 20% of the pitch t, so that the distributing action of the grooves 6 is not affected.

Figure 4:
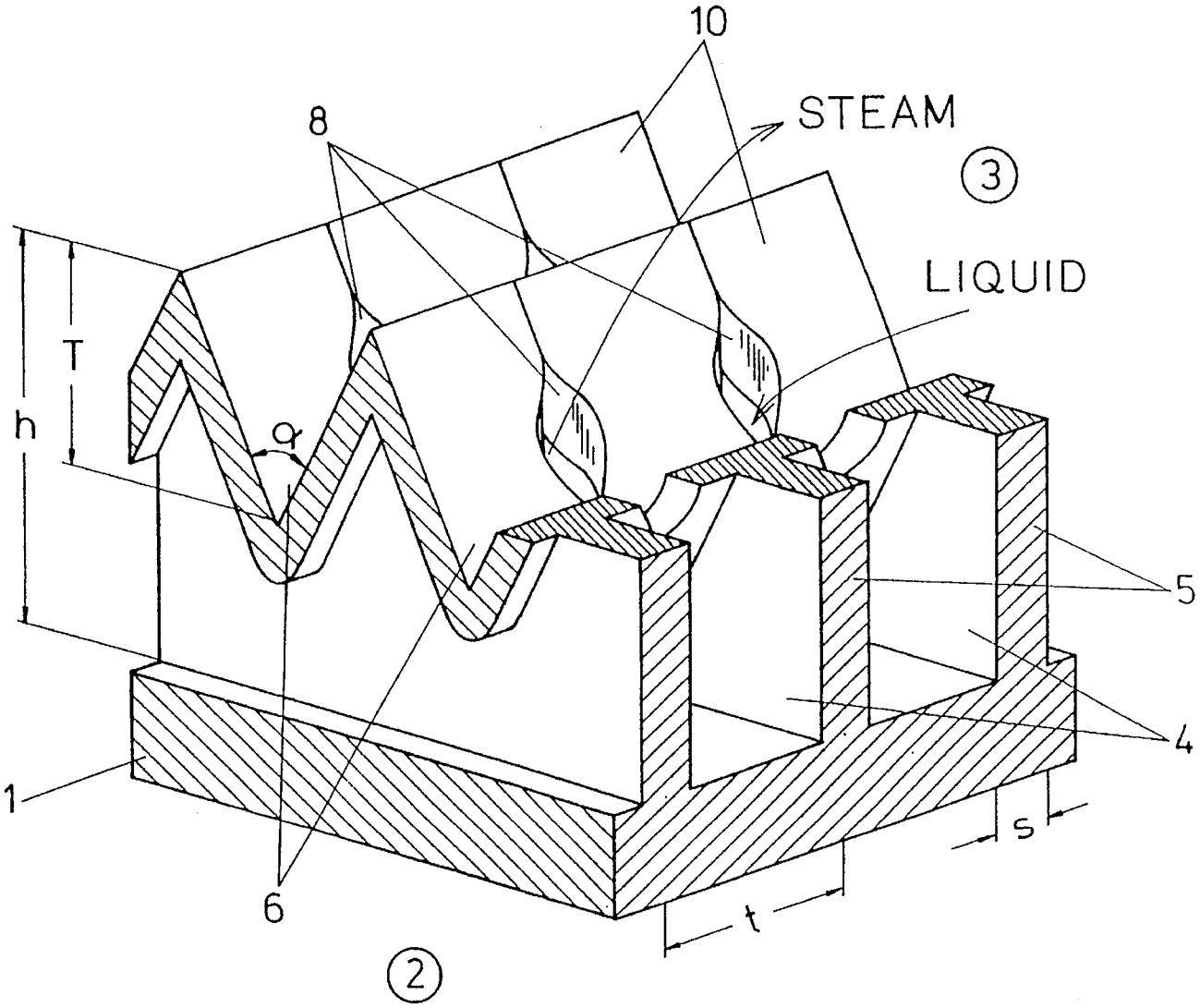
FIG. 4 shows a third embodiment of a heat exchanger wall with parallel distributor grooves according to the invention.

In the case of FIG. 4, slot-like openings 8 are formed.

In the case of FIGS. 2 and 3, the grooves 6 are spaced apart so that during the evaporation of the second medium 3, the steam (see "steam" arrow) can exit through the remaining spaces 9. The spacing a between the grooves is measured in each case between the bases of the mutually adjacent grooves 6.

In the case of FIG. 4, in which the grooves 6 directly follow one another, the openings 8 are simultaneously used for liquid input and steam output (see "liquid" and "steam" arrows).

FIG. 5 schematically shows the relationships between two crossing grooves 6.

Figure 6:
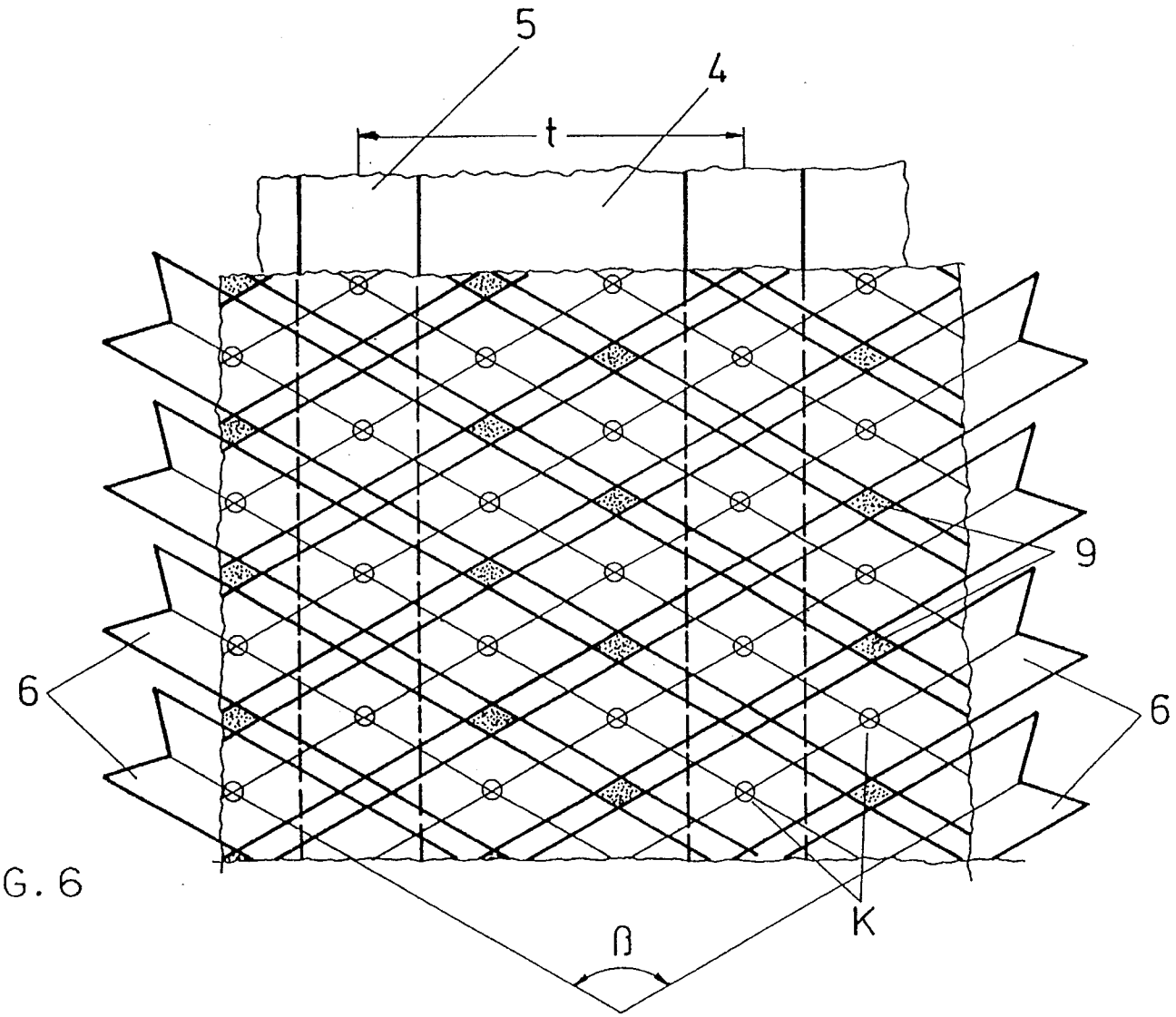
FIG. 6 shows schematically the surface structure of a heat exchanger wall with crossing distributor grooves according to the invention.

FIG. 6 shows the surface structure of a heat exchanger wall 1 of the invention with crossing distributor grooves 6 (angles of intersection β/points of intersection K). To simplify the drawing, the flared segments 7 and openings 8 are not shown. The remaining spaces 9 for the steam output are emphasized by small dots.

Figure 7D:
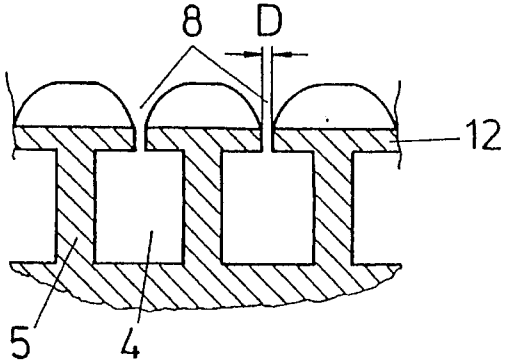
FIGS. 7*a*–7*f* show different embodiments of the openings in the flanks of the distributor grooves.
Figure 7E:
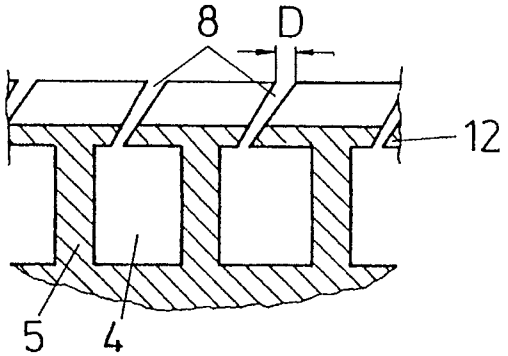
Figure 7F:
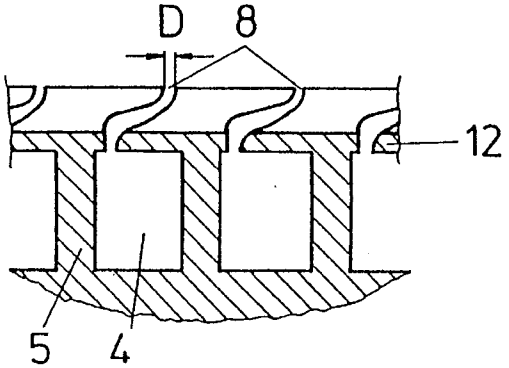
Figure 7A:
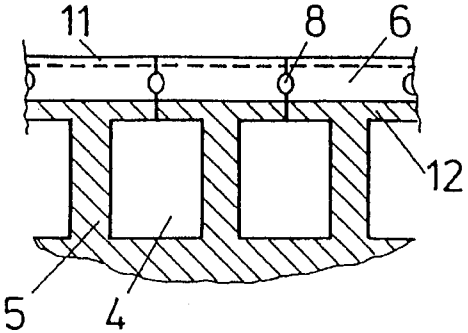
Figure 7B:
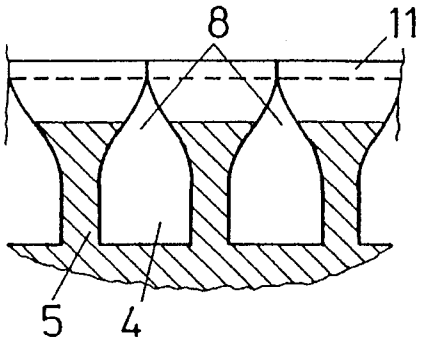
Figure 7C:
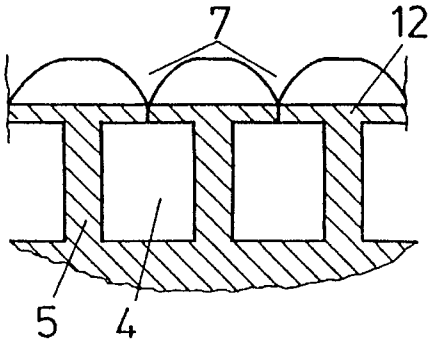

FIGS. 7*a*–7*f* illustrate various possibilities for the design of the flared segments 7 and openings 8 (compare the view corresponding to the cross-sectional plane A—A of FIG. 2 through the base of the groove). The openings 8 are designed like holes according to FIG. 7*a*, namely the flanks 10 of the grooves 6 have holes, with crests 11 and groove base 12 being continuous. According to FIG. 7*b* the crests 11 are continuous, however, the groove base 12 is perforated or open as at 8, in FIG. 7*c* the reversed situation exists. FIG. 7*d* to 7*f* illustrate further embodiments of the openings 8. The openings 8 are here formed by narrow gaps (gap width D), since the displaced material of adjacent channel walls 5 does not contact each other.

Figure 8:
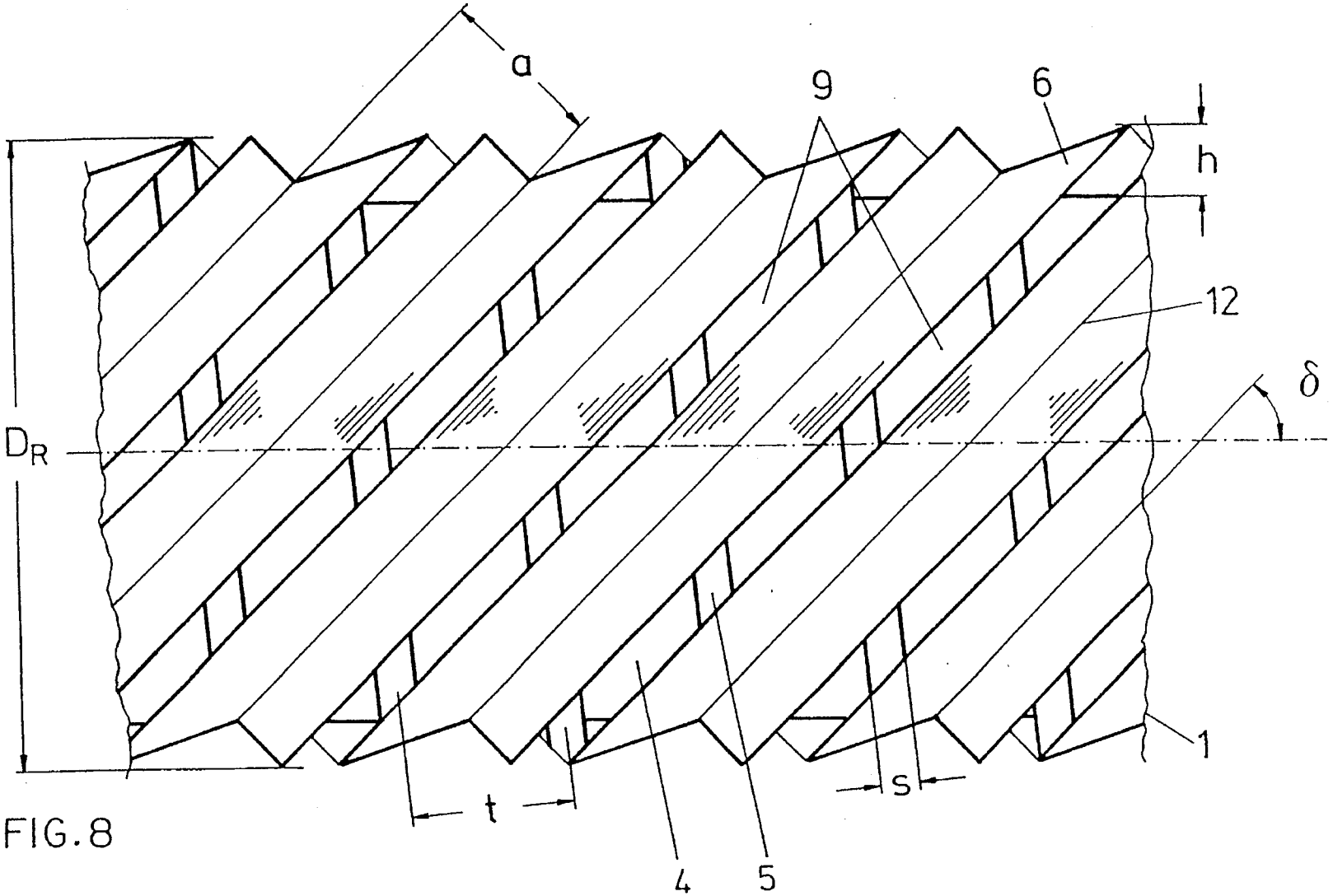
FIG. 8 shows schematically a heat exchanger tube with helically extending channels and distributor grooves.

FIG. 8 schematically shows a heat exchanger tube 1 with helically extending channels 4 (or rather channel walls 5) and distributor grooves 6 on the outer surface. The pitch angle of the distributor grooves 6 with respect to the longitudinal axis of the tube is identified with the symbol δ. The spacing a between each groove base 12 of adjacent grooves 6 is also shown. The grooves 6 were drawn in a simplified manner without flared segments 7 or openings 8.

As materials for the heat exchanger wall 1, steel, aluminum and aluminum alloys, copper and copper alloys, high-grade steels and titanium are particularly suited.

As the medium 3 to be evaporated, particularly ammonia and safety freezing mixtures, as for example R22, R134*a*, etc. are available.

Structured heat exchanger tubes 1 of steel having the following dimensions were manufactured:

| | |
|---|---|
| Outside dimension of the tube | $D_R$ = 19 mm |
| Pitch of the channels 4 | t = 0.63 mm |
| Height of the channels 4 | h = 1.0 mm |
| Thickness of the channel walls 5 | s = 0.25 mm |
| Crosswise extending distributor Grooves 6 with a pitch angle | δ = 30° (namely angle of intersection β = 120°) |
| Depth of the grooves 6 | T = 0.5 mm |
| Opening angle of the grooves 6 | α = 90°. |

When using these heat exchanger tubes 1 in a plural-tube heat exchanger for the spray vaporization of ammonia, excellent results were achieved.

The embodiments of the invention in which an exclusive property or privilege is claimed are defined as follows:

1. In a heat exchanger wall for the transfer of heat from a first medium on one side of the wall to a second medium to be evaporated on an other side of the wall, said other side having thereon integral, aligned distributor grooves for distributing a liquid phase of the second medium, the improvement wherein (a) said wall is in a form of a heat exchanger tube having plural channels defined by spaced and upstanding channel walls and means for defining plural outwardly opening distributor grooves extending transversely to the channel walls and in a contiguous, continuous and longitudinally aligned form adjacent outer edges of the channel walls, the channels and the distributor grooves each extending at an inclined angle with respect to a longitudinal axis of the tube, (b) the distributor grooves intersect the channels, the channels having a pitch t and lie below the distributor grooves, (c) the distributor grooves are formed by laterally displaced material of a radially outer portion of the channel walls to a depth T lying generally between 30% and 90% of a channel height h, the displaced material from all pairs of mutually adjacent channel walls being at least partly in contact with one another to define the contiguous, continuous and longitudinally aligned distributor groove form, and (d) the distributor grooves are connected to the channels through means defining openings in the distributor grooves.

2. The heat exchanger wall according to claim 1, wherein the distributor grooves extend parallel to one another.

3. The heat exchanger wall according to claim 2, wherein two groups of parallel distributor grooves cross at an angle β.

4. The heat exchanger wall according to claim 2, wherein the distributor grooves are arranged spaced from one another.

5. The heat exchanger wall according to claim 4, wherein the distance a between the distributor grooves is $a \leqq 3 \times t$.

6. The heat exchanger wall according to claim 1, wherein the distributor grooves are essentially V-shaped, with the depth being T=0.3 mm to 1.5 mm and the opening angle α=30° to 90°.

7. The heat exchanger wall according to claim 1, wherein the openings are designed like holes.

8. The heat exchanger wall according to claim 1, wherein the openings are designed like slots.

9. The heat exchanger wall according to claim 1, wherein the openings are formed by narrow interruptions in the distributor grooves.

10. The heat exchanger wall according to claim 1, wherein different types of openings are simultaneously arranged on one heat exchanger wall.

11. The heat exchanger wall according to claim 1, wherein the channels are parallel and have the following dimensions:

| | |
|---|---|
| Pitch | t = 0.40 mm to 1.5 mm, |
| Height | h = 0.5 × t to 2 × t, |
| Channel wall thickness | s = 0.2 × t to 0.8 × t. |

12. The heat exchanger wall according to claim 1, wherein the channels and the distributor grooves each extend helically.

13. The heat exchanger wall according to claim 12, wherein the distributor grooves extend at a pitch angle δ=30° with respect to the longitudinal axis of the tube.

14. The heat exchanger wall according to claim 1, wherein the inner surface of the heat exchanger tube is structured or ribbed.

15. The heat exchanger tube according to claim 1, wherein plural of the tubes are provided in a plural-tube spray vaporization heat exchanger.

16. The heat exchanger tube according to claim 15, wherein, in the plural-tube heat exchanger, the tubes are horizontally arranged heat.

17. The heat exchanger tube according to claim 15, wherein, in the plural-tube heat exchanger, the tubes are inclined to the horizontal.

* * * * *